US006334598B1

(12) United States Patent
Gutzke et al.

(10) Patent No.: US 6,334,598 B1
(45) Date of Patent: Jan. 1, 2002

(54) APPARATUS FOR SUPPORTING LOW-GROUND-CLEARANCE VEHICLES DURING SERVICING

(75) Inventors: Paul Harry Gutzke, Kitchener; Gordon Roy Burkholder, Brantford; James Van Kessel, Cambridge, all of (CA)

(73) Assignee: Safety Supports Inc., Brantford (CA)

( * ) Notice: Subject to any disclaimer, the term of this patent is extended or adjusted under 35 U.S.C. 154(b) by 0 days.

(21) Appl. No.: 09/490,285

(22) Filed: Dec. 28, 1999

(30) Foreign Application Priority Data

Dec. 23, 1998 (GB) ..... 9828414

(51) Int. Cl.[7] ..... A47F 5/00
(52) U.S. Cl. ..... 248/352; 211/24; 248/152
(58) Field of Search ..... 248/352, 676, 248/678, 127, 128, 129, 130, 152; 211/24, 175; 254/88

(56) References Cited

U.S. PATENT DOCUMENTS 1,131,477 A * 3/1915 Crofoot ..... 211/24
1,250,937 A * 12/1917 Achert ..... 211/24
2,524,955 A * 10/1950 Borzell et al. ..... 248/352
3,752,441 A * 8/1973 Rogers ..... 248/346
3,917,227 A * 11/1975 West ..... 248/352
4,040,521 A * 8/1977 Fitzpatrick ..... 211/24
4,205,838 A * 6/1980 McIntosh ..... 272/123
4,919,375 A * 4/1990 Miller et al. ..... 248/152
4,925,334 A * 5/1990 Beard ..... 404/9
4,971,275 A * 11/1990 Roberts ..... 248/152
5,971,362 A * 10/1999 Clark ..... 254/100
6,044,592 A * 4/2000 Strieter ..... 52/27

* cited by examiner

*Primary Examiner*—Ramon O Ramirez
*Assistant Examiner*—Tan Le
(74) *Attorney, Agent, or Firm*—Anthony Asquith & Co.

(57) ABSTRACT

End and side panels, welded together to form a frusto-pyramid, are surmounted by a dished wheel-receiving platform, for supporting a truck etc wheel. The units are wide open underneath, for stacking. Hand holes in the end panels allow the units to be manhandled and stacked. A cross-brace under the platform strengthens the structure, and holds the stacked units apart.

18 Claims, 7 Drawing Sheets

APPARATUS FOR SUPPORTING LOW-GROUND-CLEARANCE VEHICLES DURING SERVICING

BACKGROUND OF THE INVENTION

Field of the Invention

This invention relates to the task of servicing such vehicles as, for example, fork lift trucks, or airport maintenance vehicles. Such vehicles have this in common, that the vehicle is heavy, and the vehicle has such a low ground clearance that servicing underneath the vehicle requires the vehicle to be lifted off the ground. The invention is aimed at providing apparatus for safely and conveniently supporting the heavy vehicle in a wheels-raised-off-the-ground condition.

In the usual manner of operation of the apparatus, the vehicle is lifted off the ground by means of a crane, or jack, then the support apparatus of the invention are placed underneath the wheels, and the vehicle is lowered down onto the support apparatus.

The support apparatus hold the vehicle off the ground at a sufficient height to enable a mechanic to work underneath the vehicle. It is the intention that the apparatus as described herein be placed underneath the wheels, while the wheels remain on the vehicle. However, the apparatus can alternatively be used as axle stands, for supporting the vehicle when the wheels are removed.

Previously, the task of supporting low-ground-clearance vehicles off the ground for servicing has been done by lowering the vehicle down onto wooden planks. Occasionally, a prudent chief mechanic, seeing the dangers inherent in that, will have a set of wheel-stands welded up. But generally such wheel-stands are not satisfactory: they take up too much room in the shop when not in use; they have not been tested to a safe load; they are not properly designed; they are not made to proper safety margins and standards; and the possible failure modes have not been thought through. All the same, such welded-up wheel-stands are a considerable improvement over wooden planks.

SUMMARY OF THE INVENTION

The invention is concerned with providing an improved support apparatus, which combines economy of manufacture with proficiency of performance.

DETAILED DESCRIPTION OF PREFERRED EMBODIMENTS

By way of further explanation of the invention, exemplary embodiments of the invention will now be described with reference to the accompanying drawings, in which.

Figure 6A:
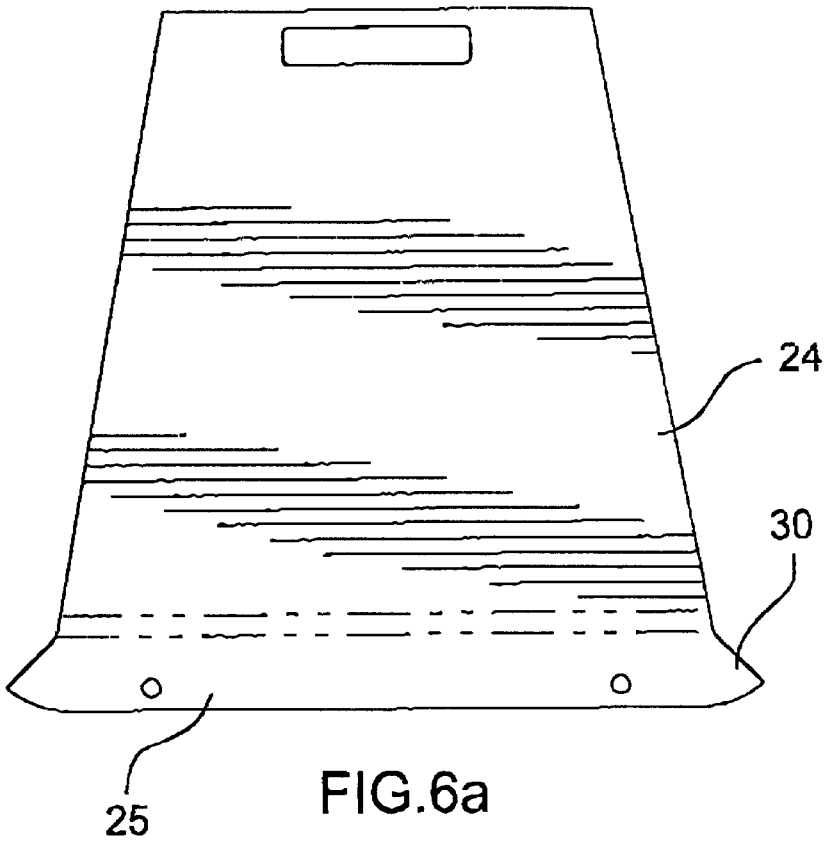

FIG. 6*a* is a plan of an end panel component of the apparatus, shown prior to assemblage into the apparatus, and prior to bending.

Figure 6B:
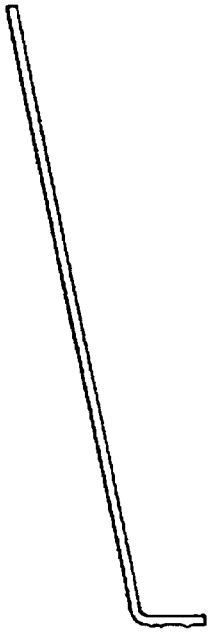

FIG. 6*b* is a side view of the component of FIG. 6, shown after bending.

Figure 7A:
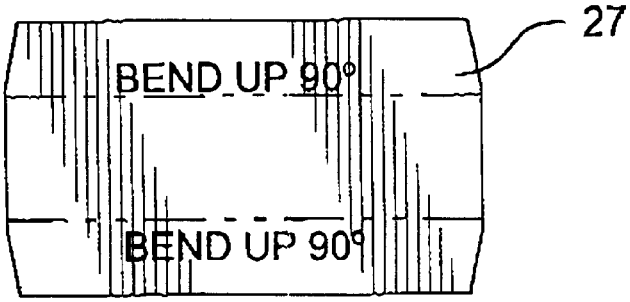

FIG. 7*a* is a plan view of a blank for a channel-piece component of the apparatus, shown prior to bending.

Figure 7C:
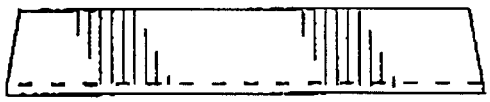
Figure 7B:
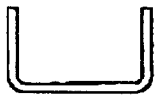

FIG. 7*b* is an end view of the piece shown in FIG. 7*a,* shown after bending.

FIG. 7*c* is a side view of the piece shown in FIG. 7*a,* shown after bending.

Figure 8A:
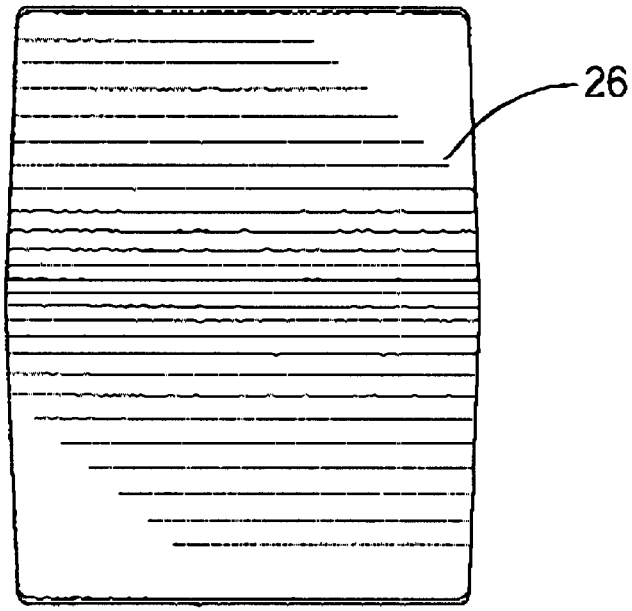

FIG. 8*a* is a plan view of a curved platform component of the apparatus.

Figure 8B:
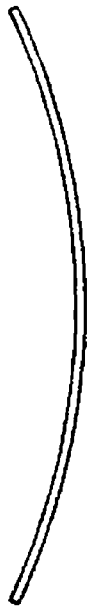

FIG. 8*b* is a side view of the component shown in FIG. 6.

Figure 3:
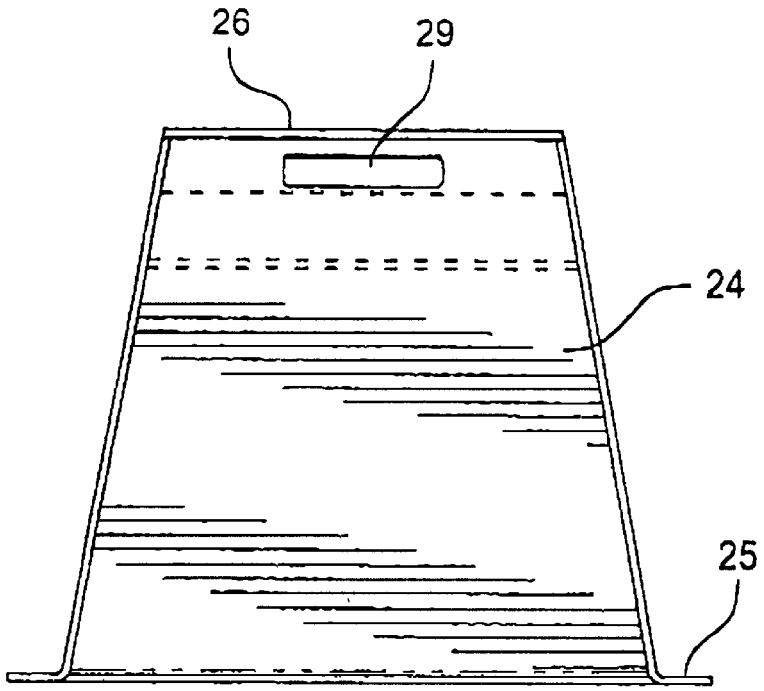
FIG. 3 is an end elevation of the apparatus of FIG. 1.
Figure 9:
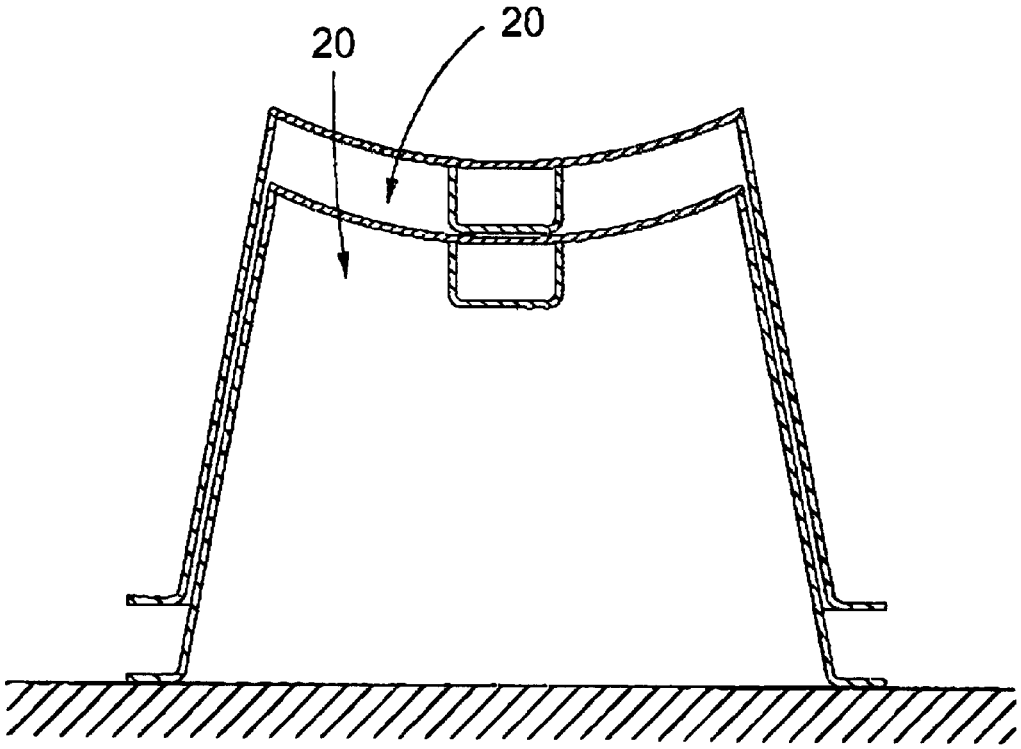

FIG. 9 is a view corresponding to FIG. 3, showing two of the apparatus in a stacked configuration, for storage.

Figure 9A:
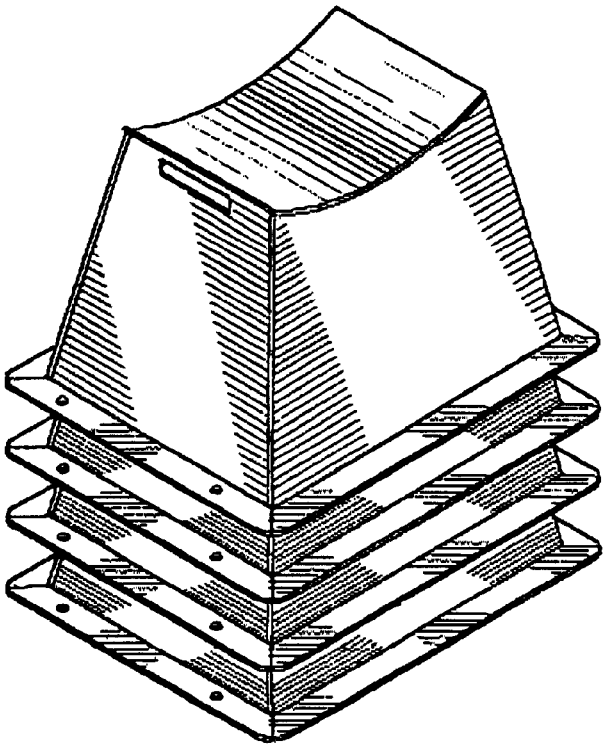

FIG. 9*a* is a pictorial view of a stack of four of the support apparatus.

Figure 9B:
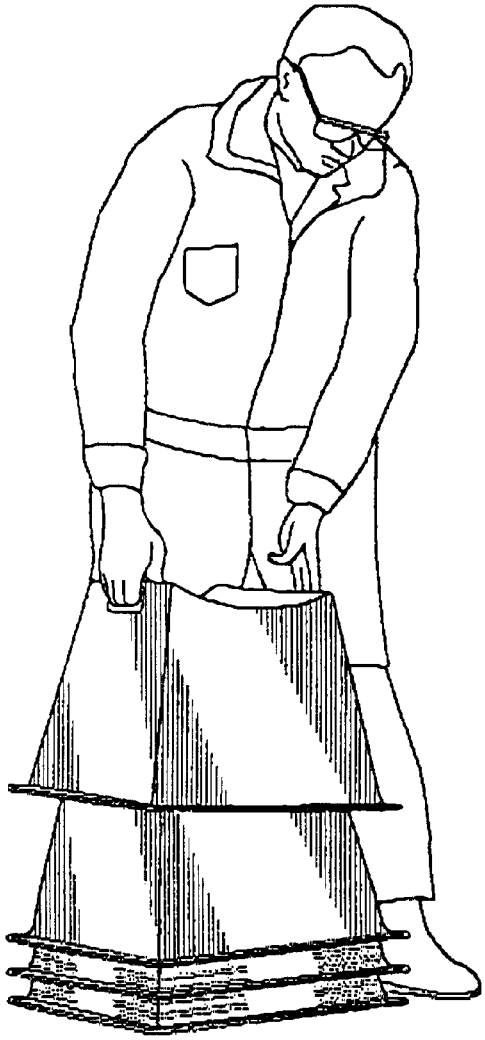

FIG. 9*b* is a pictorial view showing an operative man-handling one of the apparatus of FIG. 9*a*.

Figure 1:
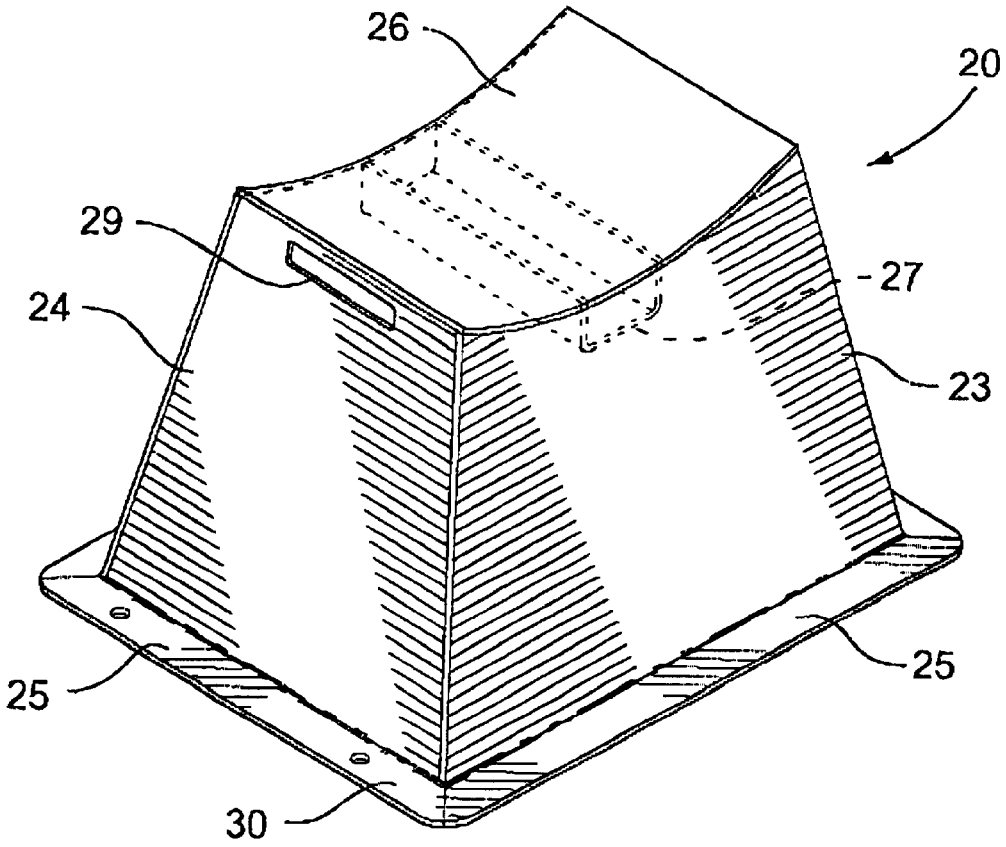
FIG. 1 is a pictorial view of a support apparatus that embodies the invention.
Figure 2:
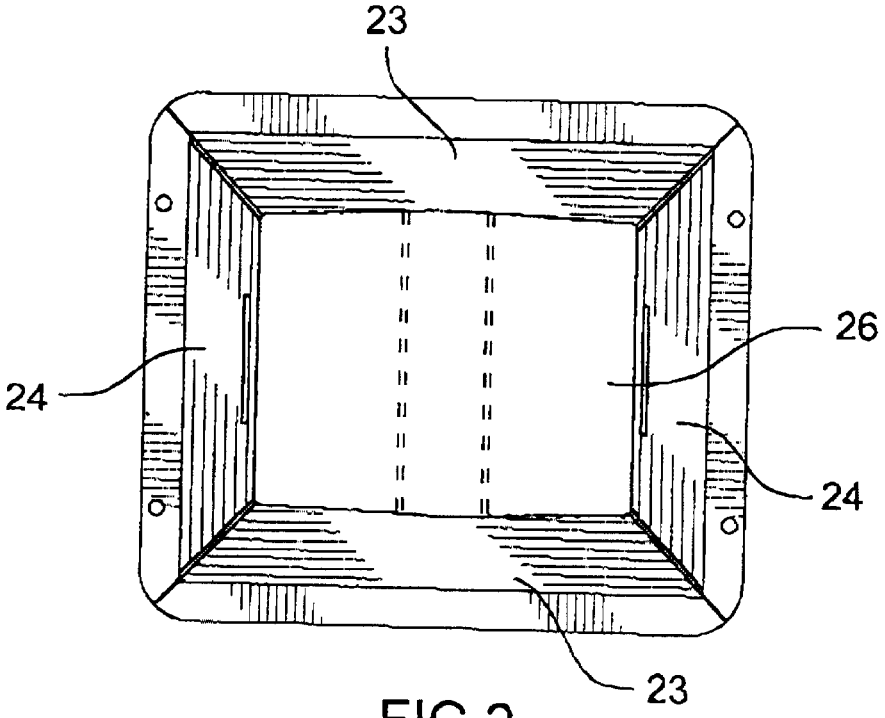
FIG. 2 is a plan view of the apparatus of FIG. 1.
Figure 10:
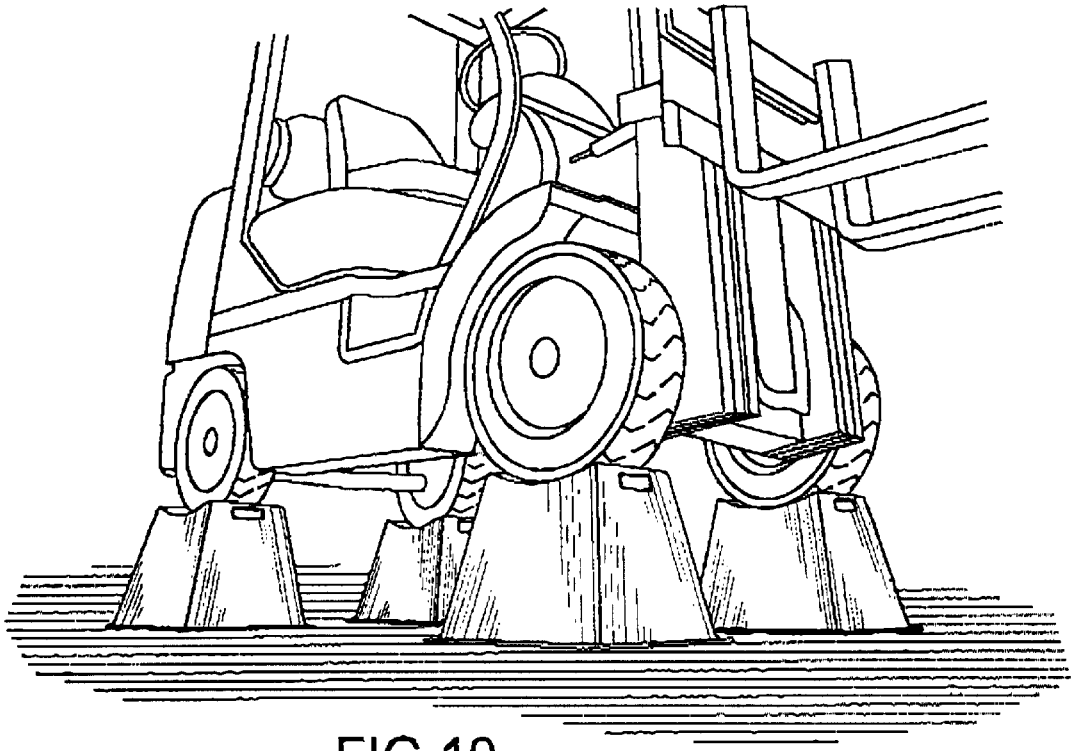

FIG. 10 is a view of a four-wheeled vehicle (a fork-lift), in which the vehicle rests in a wheels-raised-off-the-ground condition, by the use of four of the apparatus as shown in FIG. 1.

Figure 10A:
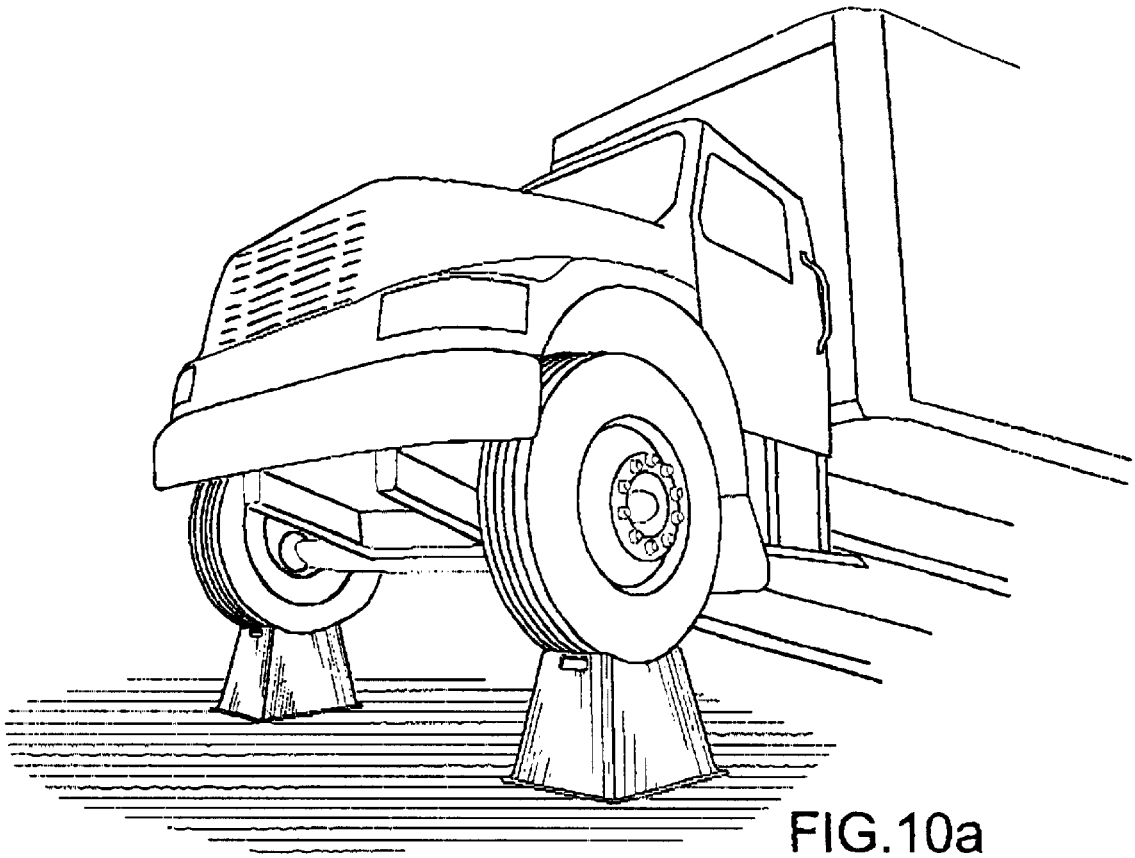

FIG. 10*a* is a pictorial view of two of the apparatus, in use to support the front wheels of a truck.

The apparatus shown in the accompanying drawings and described below are examples which embody the invention. It should be noted that the scope of the invention is defined by the accompanying claims, and not necessarily by specific features of exemplary embodiments.

The support apparatus 20 shown in FIG. 1 is of frusto-pyramidal form, having four tapering panels. The two long side panels 23 are identical to each other, and the two shorter end panels 24 are identical to each other. The panels are made of sheet metal (steel) and are generally flat, except that the panels include respective flanges 25, which are formed by bending over the material of the panels.

The apparatus includes a platform 26, which is of a curved configuration. The wheel of the vehicle being supported rests on the platform 26. The platform was made curved by passing the platform between rollers. The reason the platform 26 is curved is that such shape assists in locating a wheel against displacement when the wheel is resting on the platform. Alternatively, the platform may be e.g vee-shaped, or may otherwise include a wheel-receiving depression for wheel-locating purposes.

A channel-section piece 27 is secured underneath the centre area of the platform 26. The channel-piece 27 is also made of bent sheet metal. The components of the apparatus are cut from sheet metal, for example by laser cutting, and are welded together. The support apparatus 20 is symmetrical about its major and minor axes when viewed in plan, and about its vertical axes when viewed in side and end elevations.

In FIG. 8*a,* it will be noted that the platform component 26 is shaped, as to its cut-flat form, so as to cater for the fact that, when the platform component is curved, its sides should lie flat against the (inclined) side panel 23. Also, the ends of the channel-piece 27 are inclined (FIG. 7*c*), for the same reason.

In use, the vehicle 28 (FIG. 10) to be supported is lifted up, for example by means of a crane, and then lowered down onto the support apparatus. Each one of the support apparatus is light enough to be man-handled into place, under the wheels, by the mechanic, while the vehicle is held off the ground. The apparatus includes hand-holes 29, to facilitate the task of handling the apparatus.

During periods of non-use, the four apparatus are stacked together (FIG. 8 shows a stack of two), and stored out of the way. It will be noted that the floor-space envelope occupied by a stack of four apparatus is small, and the stack is compact.

The presence of the channel-piece 27 means that, when stacked, the apparatus do not jam themselves together. The channel-pieces hold the apparatus slightly apart vertically, which ensures they are easy to separate. The presence of the channel piece 27 also ensures that the apparatus rest sufficiently far apart that the hand-holes 29 of one apparatus are held clear of the top of the platform of the apparatus underneath, when one apparatus rests upon another; that being so, the mechanic does not injure his fingers when making the stack, i.e when lowering an apparatus down onto an already placed apparatus. The disposition of the hand-holes is such that the mechanic cannot pick up more than one apparatus at a time, which is also a safety bonus.

The primary function of the channel piece 27, in addition to holding the apparatus apart in the proper relationship when stacked, of course is to strengthen the apparatus at a critical point. If the apparatus is overloaded to the point at which permanent deformation starts to occur, one of the modes that the deformation can take, especially when the load is concentrated in the centre of the platform, is that the side panels 23 of the apparatus can start to crumple. Such crumpling is likely to start at the centre-top area of the side panels 23, i.e the location at which the channel-piece 27 is welded to the side panels. Thus the channel-piece, in addition to strengthening the platform in bending mode, also serves to alleviate buckling and crumpling in a critical area of the side panels.

The presence of the channel-piece 27 also is coordinated with the overall design of the apparatus, to ensure that the loads applied to the platform 26 are fed into the side panels 23. Thus, when the apparatus is overloaded, first it is the side panels 23 that start to crumple; however, as such crumpling progresses, the fact of the deformation of the crumpled area means that more and more of the side panel is placed under stress, while the already-crumpled portion at the top-centre of the side panel, though crumpled, remains held in position by the channel-piece, and is not deflected aside, and thus can still play its full role in supporting a proportion of the load.

Consequently, the apparatus, when overloaded, does not fail by a sudden collapse, but rather, the apparatus starts to fail by localised crumpling, being crumpling of the kind in which, as crumpling progresses, the ability of the apparatus to support further load will increase, not decrease. As a result, if too heavy a load is placed on the apparatus, the support height of the apparatus will be reduced only by a relatively small amount; after that, the partially deformed apparatus can support the overload.

An overloaded, partially-crumpled apparatus will have to be replaced, but at least the heavy load will not have been dropped to the ground, and indeed will have been largely held against tipping. This is important, given that four of the apparatus are used at once, and inevitably they will not all fail at exactly the same overload. Of course, there are limits, and of course it is possible that an overload could be so heavy that the apparatus fails more completely, and allows the load to fall or tip.

On the other hand, the frusto-pyramidal design of the support apparatus is immensely strong, and overload is most unlikely to result from lowering a vehicle that is too heavy onto the apparatus. Rather, overloading might occur during abusive situations, for example when a misplacement of equipment or other mis-chance results in excess loads being thrown onto the apparatus. Sometimes, circumstances can arise where it is necessary to service the vehicle while the vehicle is still carrying a heavy load, and overloading can arise then. It may be noted that such abuses are just as likely to occur when the vehicle is being supported by a support means other than that described herein, in which case the overload could, all too easily, lead to a disastrous sudden complete failure of the support means.

Figure 5:
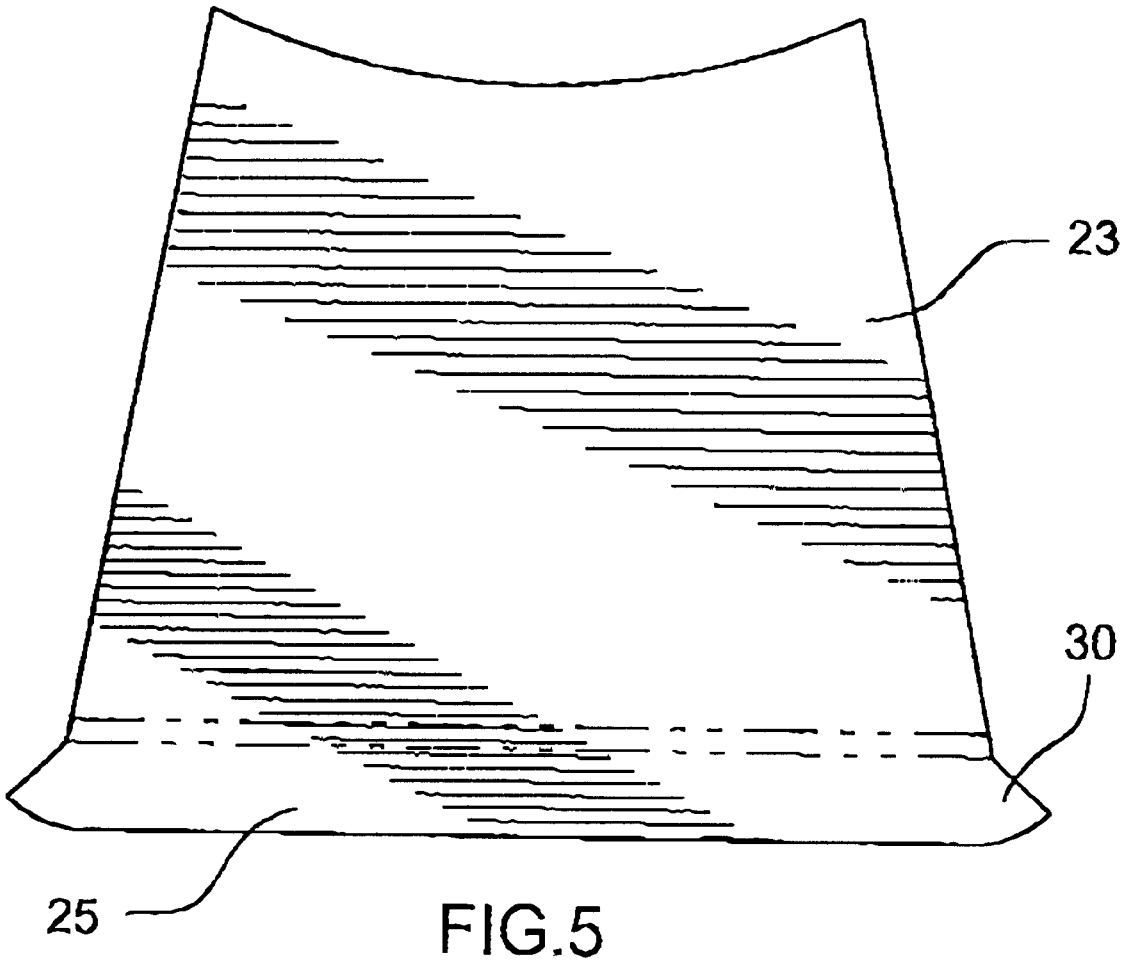
FIG. 5 is a plan of a side panel component of the apparatus, shown prior to assemblage into the apparatus.

As may be seen in FIGS. 5,6*a* the outline of the side panels, prior to bending, includes a portion 30 that will form a tab, after bending,(FIG. 6*b*) for welding the corners of adjacent panels together. The presence of the tab portion 30 means that the outline cannot be cut on a shearing machine of the brake-press type. However, the shape as shown presents no problems if the components are to be shaped by being cut on an N.C. laser cut-out machine.

The components of the apparatus are welded together. The design is such that it is a simple matter to tack the panels together, and then fill in with the continuous welds. With the apparatus inverted, there is easy access for welding the components from the inside; that is to say, the same open bottom that permits stackability of the apparatus also means there is open space for access to weld the inside. (It may be noted that articles of comparable size, and quantity of welding, as the apparatus depicted herein often present quite a difficult welding job, because of poor access to the inside.)

As far as stackability is concerned, it may be noted that there is no need to stack the apparatus more than four high. Thus, the designer need not be concerned about a stack toppling over, nor about stacking the items as close together vertically as possible.

The designer should have in mind: that the items be light enough that they can be picked up; that the mechanic be able to pick up and set down the items, both on the ground and on each other, without injuring his fingers; and that the items cannot include cross-braces near the bottom of the panels. The design as depicted enables a support apparatus to be constructed from (inexpensive) sheet metal, in which the apparatus is light enough in weight to be easily stackable, but in use is strong, rigid, wide-based and very stable.

It is the intention that the apparatus as described will be used to support a road wheel, i.e a wheel with a tire, and as such it can be expected that the load from the wheel will be distributed fairly evenly over the (curved) platform. The larger the wheel (and hence, usually, the heavier the load) the larger the area of the platform over which the load is spread—and, it may be noted, inasmuch as the load extends towards the ends of the platform, in that case the more the end panels 24 can play a part in directly supporting the load. However, the designer (and the load-rating inspector) must also cater for the fact that the apparatus might be used as an axle stand, in which all the load is concentrated in the centre of the platform.

The apparatus as described, when constructed industrially, can be expected to support a rated working load of six tons, per apparatus, with an adequate margin of safety. Actual permanent-deformation failure of the apparatus can be expected not to occur at loads less than about 25 tons.

Figure 4:
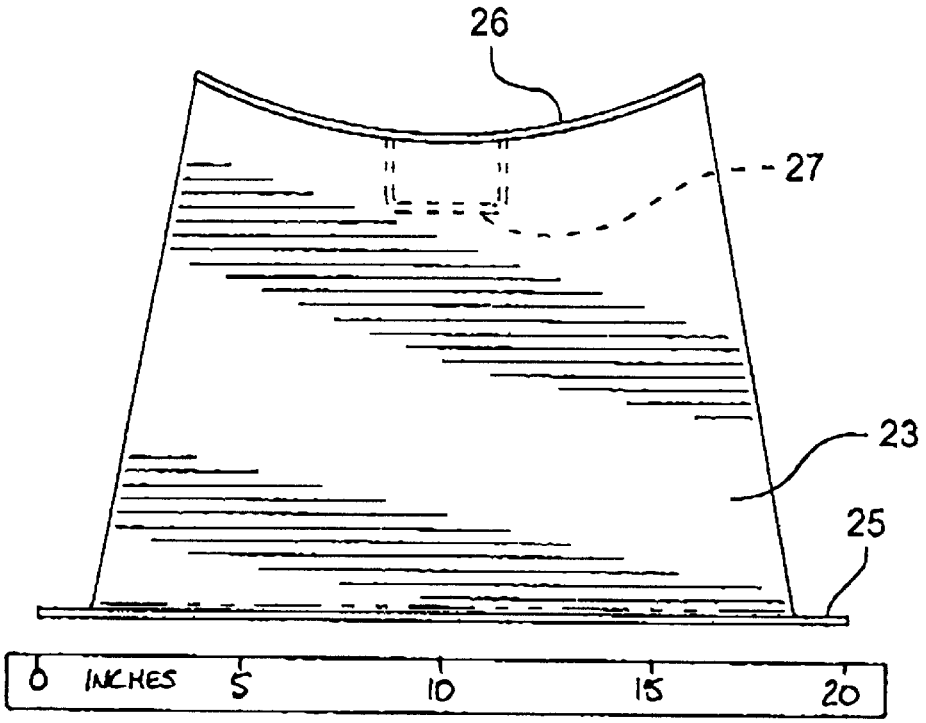
FIG. 4 is a side elevation of the apparatus of FIG. 1.

The dimensions of the exemplary structure as described can be derived from the scale appearing on FIG. 4. The panels slope inwards at about 10 degrees: if the slope were less than about 5 degrees, the inherent load-supporting stability of the pyramid shape would be lost; plus the apparatus would not be so easily stackable.

The pyramid shape of the panels is rectangular in horizontal cross-section, which, near the platform measures about 23×30 cm, and near the ground measures about 34×41 cm. Using sheet metal about 5 mm thick, the weight of this apparatus is a manageable 37 lbs.

Of course, the apparatus may be made to other dimensions, to suit particular vehicles. But the dimensions as described above give a unit that is generally suitable for holding the wheels of road-going trucks, in-factory fork-lifts, etc, etc, at a lift-height of about 30 cm off the ground. For a smaller lift-height, the designer would specify smaller height dimensions of the apparatus, but the length and width of the apparatus could remain the same.

The channel-piece extends down from the underside of the platform such as to hold the stacked apparatus about 4.5 cm apart. If this distance were less than about 3 cm, a person's fingers might be trapped when manhandling stacked apparatus, and the strengthening effect of the channel-piece would be lost (bearing in mind that the channel-piece supplies reinforcement right at the place where the load is concentrated); if more than about 8 cm, a stack of four apparatus might become unstable.

What is claimed is:

1. An apparatus for supporting one wheel of a heavy, low-ground-clearance, vehicle during servicing, wherein:

the apparatus is made of pieces of sheet metal, including a platform, including spaced opposed front and rear end panels, and including spaced opposed left and right side panels;

the panels are welded together, in such manner that the apparatus has the general configuration of an upturned hollow box, with the platform on top;

a wheel-receiving depression is formed in the platform;

the apparatus has a bottom rim, which is adapted for resting on the ground, and the bottom rim is so arranged as to spread the load of the wheel onto a comparatively large area of the ground;

at least some of the panels slope inwards, whereby either the end panels or the side panels are further apart at the bottom than at the top;

the apparatus is wide open at the bottom;

and the apparatus is capable of being arranged with other, similar, apparatus, one above and partially inside another, in a stack.

2. The apparatus of claim 1, wherein the apparatus is of a generally rectangular frusto-pyramidal shape.

3. The apparatus of claim 2, wherein both the side panels and the end panels slope inwards, in the sense that the end panels lie further apart at the bottom than at the top, and the side panels lie further apart at the bottom than at the top.

4. The apparatus of claim 3, wherein the side panels and the end panels slope inwards at angles to the vertical of between 5 degrees and 15 degrees.

5. The apparatus of claim 2, wherein the apparatus is symmetrical about a front-rear axis and about a left-right axis.

6. The apparatus of claim 2, wherein:

the sheet metal of the panels is about 5 mm thick;

the apparatus is about 33 cm high overall, and supports the wheel about 30 cm off the ground;

in plan view, the top edges of the panel form a rectangle about 23×30 cm;

the bottom edges of the panels form a rectangle, which has a clear open internal area, being a 34×41 cm rectangle.

7. The apparatus of claim 2, wherein the top platform is concavely cylindrically curved at a radius of 37 cm.

8. The apparatus of claim 2, wherein the panels are formed from respective separate panel-pieces of sheet steel, welded together.

9. The apparatus of claim 8, wherein all four of the panel-pieces are bent outwards at the bottom to form bottom flanges, and the flanges comprise the bottom rim.

10. The apparatus of claim 2, wherein the platform overlies the top edges of the side-panels and the end-panels, but the platform substantially does not protrude outwards beyond the panels.

11. A plurality of apparatus, each of which is an apparatus as claimed in claim 1, wherein:

the apparatus are arranged one above the other, in a vertical stack;

the apparatus in the stack are provided with respective hand-holes;

the apparatus in the stack include respective separators, which are effective to hold the apparatus in position in the stack in such a separated relationship as to enable the safe usage of the hand-hole.

12. An apparatus for supporting one wheel of a heavy, low-ground-clearance, vehicle during servicing, wherein:

the apparatus is made of pieces of sheet metal, including a platform, including spaced opposed front and rear end panels, and including spaced opposed left and right side panels;

the panels are welded together, in such manner that the apparatus has the general configuration of an upturned hollow box, with the platform on top;

a wheel-receiving depression is formed in the platform;

the apparatus has a bottom rim, which is adapted for resting on the ground, and the bottom rim is so arranged as to spread the load of the wheel onto a comparatively large area of the ground;

at least some of the panels slope inwards, whereby either the end panels or the side panels are further apart at the bottom than at the top;

the apparatus is wide open at the bottom;

the apparatus is capable of being arranged with other, similar, apparatus, one above and partially inside another, in a stack;

the apparatus is of a generally rectangular frusto-pyramidal shape;

the apparatus includes a cross-brace, which is located under the platform;

the cross-brace extends down into the interior of the apparatus, down from the underside of the platform;

the cross-brace connects the left and right side-panels, and is fixed to the platform and the side-panels in such manner as assist in transmitting forces arising from a wheel on top of the platform smoothly into the side-panels.

13. The apparatus of claim 12, wherein the cross-brace extends down from the underside of the platform far enough that, and the apparatus is so dimensioned that, when the apparatus is stacked on top of another similar apparatus, the underside of the cross-brace of the apparatus can rest in contact with the top surface of the platform of the said other apparatus.

14. The apparatus of claim 13, wherein:

the end-panels are provided with hand-holes, located at or near the tops of the end-panels;

the apparatus is so dimensioned that when the apparatus is stacked, with the underside of the cross-brace resting on the platform of the said other apparatus, the platform of the said other apparatus lies far enough below the hand-hole of the apparatus as to enable the safe usage of the hand-hole.

15. The apparatus of claim 14, wherein the cross-brace is so dimensioned as to ensure that, when several of the apparatus are stacked, the apparatus lie pitched a distance D apart, where the distance D is between 3 cm and 8 cm.

16. The apparatus of claim 14, in combination with three other, identical, apparatus, comprising a set of four apparatus.

17. The apparatus of claim 12, wherein the cross brace is channel-shaped, and is welded to the side-panels, and is also welded to underside of platform, in such manner as to form a totally enclosed box.

18. The apparatus of claim 17, wherein the totally enclosed box is about 45 mm×75 mm in cross-section.

* * * * *